US005916853A

United States Patent [19]

Hamori et al.

[11] Patent Number: 5,916,853

[45] Date of Patent: Jun. 29, 1999

[54] LUBRICATING GREASE COMPOSITION, PROCESS FOR ITS PREPARATION AND ITS USE

[75] Inventors: Dezsö Hamori, München; Dirk Loderer, Gilching; Dieter Sohn, Greifenberg; Norbert Geheeb, Bamberg, all of Germany

[73] Assignees: Kluber Lubrication Munchen KG, Münich; INA Wälzlager Schaeffler oHG, Herzogenaurach, both of Germany

[21] Appl. No.: 09/115,796

[22] Filed: Jul. 15, 1998

[30] Foreign Application Priority Data

Jul. 15, 1997 [DE] Germany ..... 197 30 318

[51] Int. Cl.[6] .....

[52] U.S. Cl. ..... 508/439

[58] Field of Search ..... 508/439

[56] References Cited

U.S. PATENT DOCUMENTS 4,440,657 4/1984 Metro et al. ..... 508/439

4,919,833 4/1990 Miles ..... 508/439

5,032,309 7/1991 Miles ..... 508/439

*Primary Examiner*—Jacqueline V. Howard

*Attorney, Agent, or Firm*—Kubovcik & Kubovcik

[57] ABSTRACT

A lubricant grease composition comprising is disclosed. The composition includes:

(a) an oil or oil mixture of one or more ester of aromatic tricarboxylic or tetracarboxylic acids with an alcohol or a mixture of alcohols having the general composition $C_nH_{2n+1}OH$ with n=7 to 22 and/or one or more of the esters of trimethylolpropane, pentaerythritol or dipentaerythritol with aliphatic carboxylic acids having the general composition $C_nH_{2n+1}COOH$ with n=6 to 21, (b) a thickening agent comprising a biurea and/or polyurea, and (c) a wear-protecting additive comprising a mixture of the components triaryl phosphorothionate, $C_8$–$C_{20}$ alkylamino monohexyl and dihexyl phosphate and $C_1$–$C_8$-alkylamino isobutyl phospate.

7 Claims, 4 Drawing Sheets

LUBRICATING GREASE COMPOSITION, PROCESS FOR ITS PREPARATION AND ITS USE

BACKGROUND OF THE INVENTION

1. Field of the Invention

The invention concerns a lubricating grease composition, a process for its preparation, and its use.

2. Description of Related Art

Lubricants are widely used. They are used, for example, in vehicles, production, machine-building, office equipment, industrial plants and machines, household machines, and in maintenance.

The general progress of technology has set new and more extensive requirements for lubricant grease compositions, and must involve development of new lubricants. The known lubricants based on petroleum or synthetic oils no longer satisfy such requirements.

The useful lifetime of a lubricant grease at its upper use temperature is one of the most important parameters of such a grease. A long useful life (=long running time) indicates a high resistance to wear. For a high temperature of 180° C., the $F_{50}$ value, which is determined according to DIN 51821, must be greater than 100 hours, and it is desirable to exceed this value as much as possible. This is not accomplished satisfactorily by existing lubricant grease compositions.

An object of the invention, therefore, is to provide a lubricant grease composition with a long lubricating lifetime and high protection against wear.

BRIEF SUMMARY OF THE INVENTION

The above objective is attained according to the present invention by means of a lubricant grease composition comprising an oil or mixture of oils, a thickening agent, and a wear-protecting additive.

DETAILED DESCRIPTION

Figure 1:
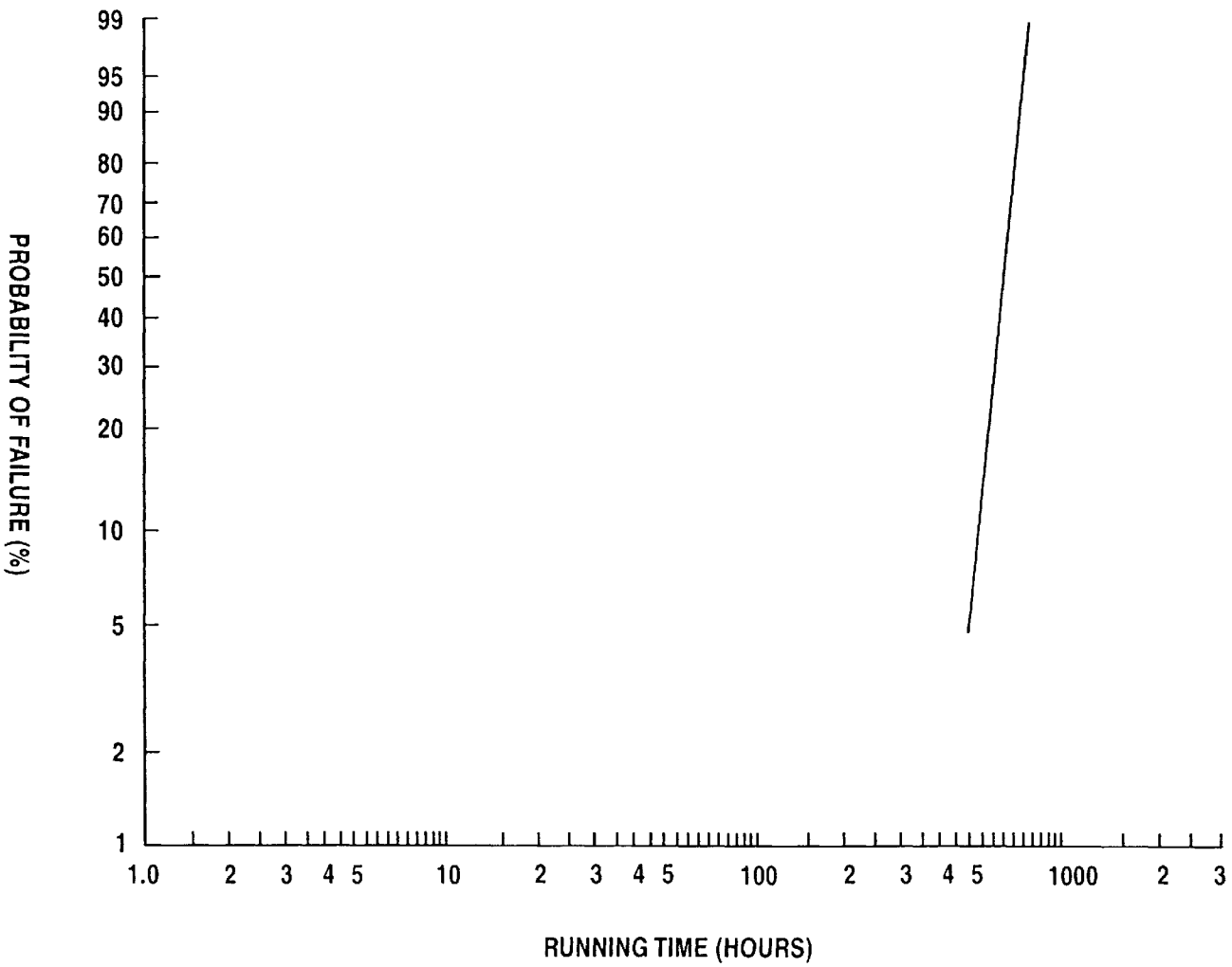
FIG. 1 is a graph illustrating the useful life of a lubricant grease composition according to the invention, produced as described in Example 1.

The oil or oil mixture comprises one or more esters of aromatic tricarboxylic or tetracarboxylic acids, such as trimellitic acid or pyromellitic acid, with an alcohol or a mixture of alcohols having the general composition $C_nH_{2n+1}OH$ with n=7 to 22 and/or one or more esters of trimethylolpropane, pentaerythritol, or dipentaerythritol with aliphatic carboxylic acids having the general composition $C_nH_{2n+1}COOH$ with n=6 to 21. Trimellitic acid tri (tridecyl) ester or pyromellitic acid tetra(2-ethylhexyl) ester is preferred for use.

The thickening agent comprises a bi- and/or poly-urea. This is the reaction product of a diisocyanate, preferably 2,4-diisocyanatotoluene, 2,6-diisocyanatotoluene, 4,4'-diisocyanatodiphenylmethane, 4,4'-diisocyanato-3,3'-dimethylphenyl, or 4,4'-diisocyanato-3,3'-dimethyldiphenylmethane, alone or mixed with an amine or a mixture of amines having the general formula $(H_2N)_xR$, in which when x=1, R is an alkyl or alkylene group with 6 to 22 carbon atoms or an aryl group with 6 to 12 carbon atoms and when x=2, R is an alkyl group with 2 to 6 carbon atoms or an aryl group with 6 to 14 carbon atoms.

2,4-Toluidine-N,N'-dicyclohexylbiurea or N,N'-dicyclohexyl-N",N'"-(4,4'-diphenylmethane)biurea is preferably used.

The wear-protecting additive comprises a mixture of the components triarylphosphorothionate, $C_8$–$C_{20}$ alkylamino monohexyl and/or dihexyl phosphate and $C_1$–$C_8$-alkylamino isobutyl phosphate. Tri-(4-methylphenyl) phosphorothionate, primary dodecylammonium dihexyl phosphate and primary hexylammonium diisobutyl phosphate are preferred.

The lubricant grease composition according to the invention preferably comprises 70 to 90% by weight of the oil or oil mixture, 5 to 29% by weight of the thickening agent, and 1 to 5% by weight of the wear-protecting additive, based on the lubricant grease composition. The wear-protecting additive can comprise 10 to 40% by weight triaryl phosphorothionate, 5 to 30% by weight of $C_8$–$C_{20}$ alkylamino monohexyl and/or dihexyl phosphate and 20 to 60% by weight of $C_1$–$C_8$-alkylamino isobutyl phosphate, based in each case on the wear-protecting additive.

In the determination of the upper use temperature of 180° C. for the lubricant grease compositions according to the invention as specified in DIN 51821, using a FAG FE-9 testing machine, running times attained were $L_{10}$>300 hours and $L_{50}$>400 hours.

The lubricant grease composition according to the invention has a usable temperature range of −50 to 200° C.

The lubricant grease compositions according to the invention can also contain the usual additives against corrosion and oxidation and for protection against the effects of metals, which act as radical traps, chelating agents, UV converters, reaction layer components, and the like.

The lubricant grease compositions according to the invention are obtained by mixing the components of the wear-protecting additive with part of the oil or oil mixture below 80° C., adding the resultant mixture to a mixture of the thickening agent with the rest of the oil or oil mixture, and then homogenizing with a high-pressure homogenizer and/or a three-roll mill. The portion of the oil or oil mixture added to the wear-protecting additive is preferably 3 to 10% by weight, based on the lubricant grease composition. The rest of the oil or oil mixture for the lubricant grease composition is reduced by that amount.

Because of the presence of the wear-protecting additive described above, the lubricant grease composition gains unexpectedly high wear protection. This is shown by the fact that extremely long running times of $F_{10}$>300 hours and $F_{50}$>400 hours were attained in determining the upper use temperature with a FAG FE-9 test machine according to DIN 51821. These values clearly exceed the required value for $F_{50}$, of greater than 50 hours.

Therefore the lubricant grease composition according to the invention is extremely suitable as a lubricant in vehicles, production, machine-building, office equipment, industrial plants and machines, household machines, and in maintenance.

The invention is illustrated further by the following examples:

EXAMPLE 1

Figure 2:
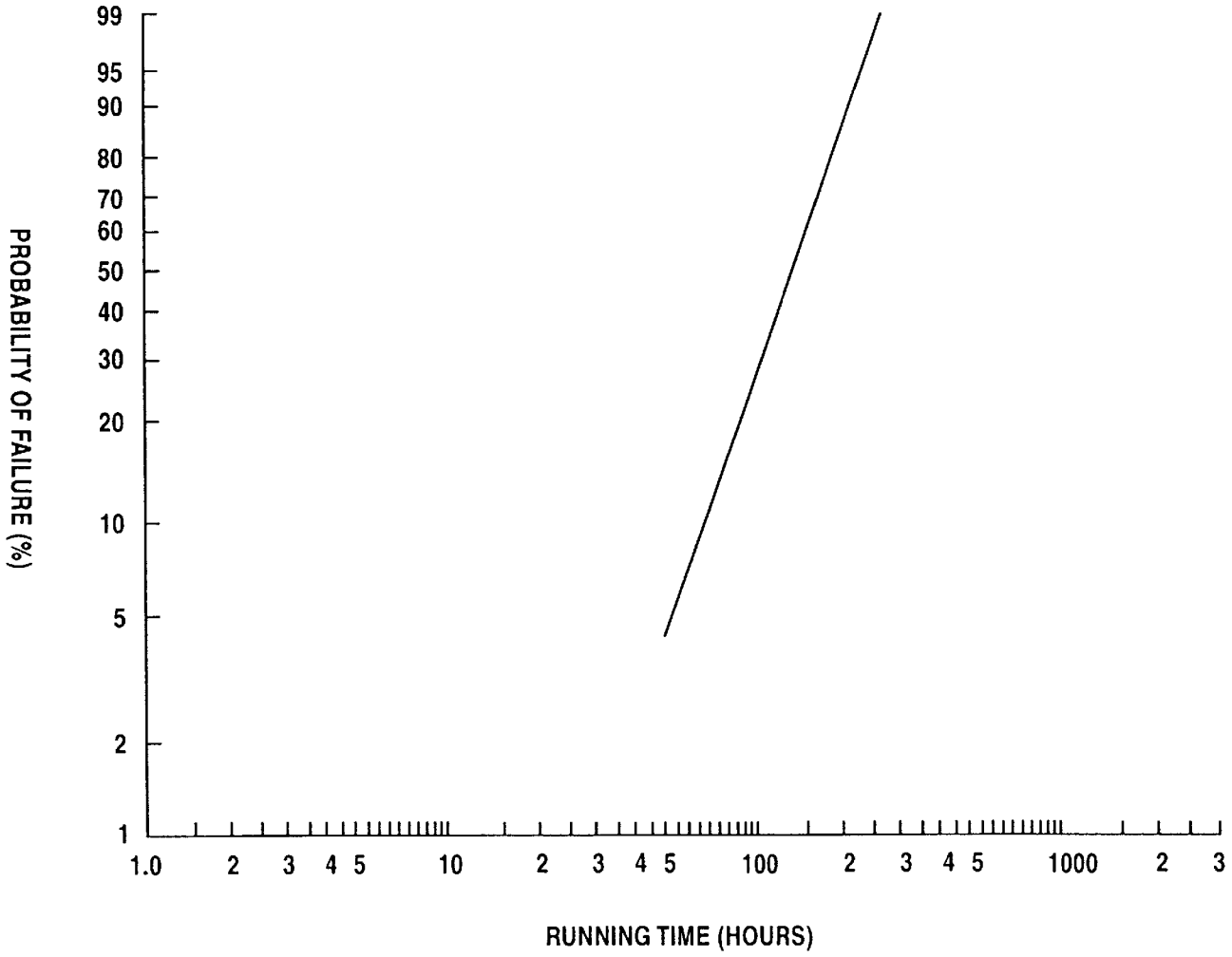
FIG. 2 is a graph illustrating the useful life of an ordinary commercial lubricant grease composition.

108.7 g of a mixture of 2,4- and 2,6-toluene diisocyanate was reacted with 116.2 g phenetidine in 700 g of a trimellitic acid ester (trimellitic acid tri(tridecyl) ester). The mixture was heated to 180° C. and then cooled. Then 128 g of a mixture of 11.2 g tri-(4-methylphenyl) phosphorothionate, 8.4 g primary dodecylammonium dihexyl phosphate, 8.4 g primary hexylammonium diisobutyl phosphate and 100 g of trimellitic acid ester (trimellitic acid tri(tridecyl) ester) was added at a mixing temperature of less than 80° C. After homogenization with a three-roll mill, a lubricant grease of NLGI Class 2 was obtained. It had a particularly long life at a temperature of 180° C. on the FAG FE-9 test machine. FIG. 1 shows the useful lubricant life of the composition according to the invention. For comparison, a commercial polyurea lubricant grease composition was tested under the same test conditions. The results are shown in FIG. 2. In FIGS. 1 and 2, the ordinate represents the probability of failure for the test bearing sample (%) abscissa represents the running time (hours). It is apparent that the lubricant lifetime of the composition according to the invention is several times better.

The test parameters and results are summarized below.

| | |
|---|---|
| Volume used ($cm^3$): | 2.0 |
| Speed, n (rpm): | 6,000 |
| Axial load $F_a$ (Newtons): | 1,500 |
| Temperature (° C.): | 180° |
| Assembly: | A |

Test evaluation:

| Invention | Comparison |
|---|---|
| $F_{10}$ = $L_{10}$ = 510 hours | $F_{10}$ = $L_{10}$ = 61.8 hours |
| $F_{50}$ = $L_{50}$ = 600 hours | $F_{50}$ = $L_{50}$ = 123.8 hours |
| β = 11.5 | β = 2.71 |

Running times (hours)

| Bearing No. | Invention | Comparison |
|---|---|---|
| 1 | 523 | 200 |
| 2 | 603 | 101 |
| 3 | 652 | 86 |
| 4 | 593 | 95 |
| 5 | 605 | 140 |

EXAMPLE 2

90.5 g of a mixture of 2,4- and 2,6-toluene diisocyanate was reacted with 102.4 g of cyclohexylamine in 600 g of a pyromellitic acid ester (pyromellitic acid tetra(2-ethylhexyl) ester). The mixture was heated to 180° C. and then cooled. Then 135 g of a mixture of 3.5 g tri-(4-methylphenyl) phosphorothionate, 10.5 g primary dodecylammonium dihexyl phosphate, 21 g primary hexylammonium diisobutyl phosphate and 100 g of pyromellitic acid ester (pyromellitic acid tetra-(2-ethylhexyl) ester) were added at a mixing temperature of less than 80° C. After homogenization with a high-pressure homogenizer, a lubricant grease of NLGI Class 2 was obtained. It had a particularly long lifetime on the FAG GE-9 machine at a temperature of 180° C.

Figure 3:
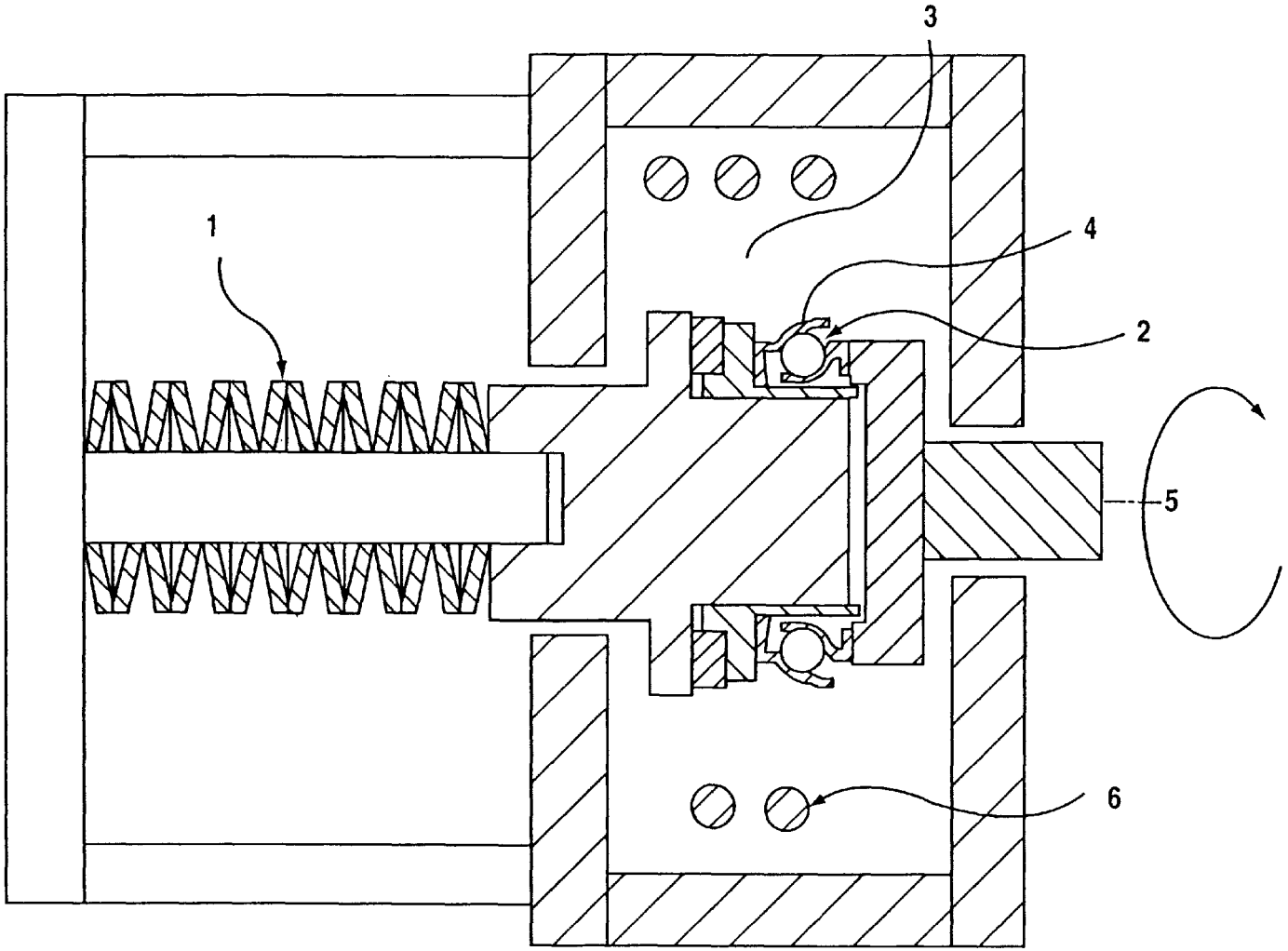
FIG. 3 shows a 12-position test stand for testing the AL lifetime (running time) with a set of cup springs 1, a test sample 2, a temperature sensor for the circulating air 3, a temperature sensor on the outer ring 4, an electric motor 5 and a heater 6.
Figure 3:
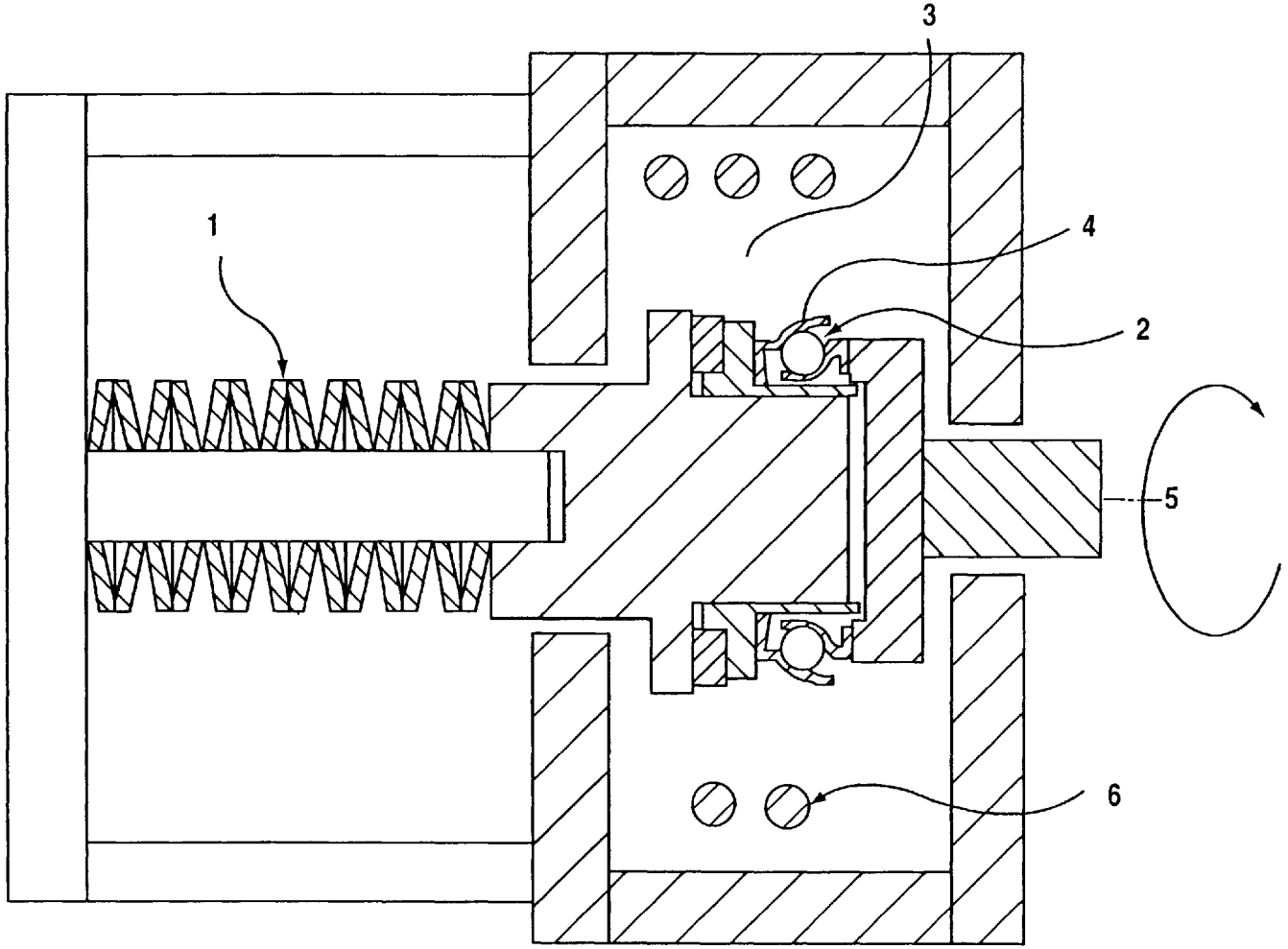

A clutch release bearing was subjected to a continuous load test in a test stand, the design of which is shown in FIG. 3, using the lubricant grease compositions described in the invention. The test conditions were as follows:

Axial load ($F_{AX}$)=2,000 N

Speed=6,000 RPM

T=120° C.

The criterion for evaluating the lubricant was complete failure of the test bearing. Use of the lubricant grease composition according to the invention increased the running time of the clutch release bearing from 1,200 to 2,000 hours in a test run. This means that a significant increase in capability was achieved in the mixed or dry friction regions, especially in the high-temperature range of 140 to 180° C.

What is claimed is:

1. A lubricant grease composition comprising:

(a) an oil or oil mixture of one or more esters selected from the group consisting of ester of an aromatic tricarboxylic or tetracarboxylic acid with an alcohol or a mixture of alcohols having the general composition $C_nH_{2+1}OH$ with n=7 to 22; esters of trimethylolpropane, pentaerythritol or dipentaerythritol with aliphatic carboxylic acids having the general composition $C_nH_{2+1}COOH$ with n=6 to 21, and mixtures thereof;

(b) a thickening agent comprising a biurea and/or polyurea; and (c) a wear-protecting additive comprising a mixture of triaryl phosphorothionate, $C_8$–$C_{20}$ alkylamino monohexyl and/or dihexyl phosphate and $C_1$–$C_8$-alkylamino isobutyl phosphate.

2. A lubricant grease composition according to claim 1, comprising 70 to 90% by weight of the oil or oil mixture (a), 5 to 29% by weight of the thickening agent (b) and 1 to 5% by weight of the additive (c), each percentage being based on the lubricant grease composition.

3. A lubricant grease composition according to claim 2, wherein additive (c) comprises 10 to 40% by weight triarylphosphorothionate, 5 to 30% by weight of $C_8$–$C_{20}$ alkylamino monohexyl and/or dihexyl phosphate and 20 to 60% by weight of $C_1$–$C_8$-alkylamino isobutyl phosphate, each percentage being based on additive (c).

4. A lubricant grease composition according to claim 1, 2 or 3, which provides running times of $L_{10}$>300 hours and $L_{50}$>400 hours in determining the upper use temperature of 180° C. with a FAG FE-9 test machine according to DIN 51821.

5. A lubricant grease composition according to claim 1, 2 or 3, having a use temperature range of from −50 to 200° C.

6. A process for preparing a lubricant grease composition according to any one of claims 1 to 3, comprising mixing additive (c) with part of the oil or oil mixture (a) below 80° C., adding the resultant mixture to a mixture of the thickening agent (b) and the remaining portion of the oil or oil mixture (a) and then homogenizing.

7. A process according to claim 6, wherein the portion of the oil or oil mixture (a) mixed with the additive (c) is 3 to 10% by weight, based on the lubricating grease composition.

* * * * *